United States Patent [19]

Englund

[11] Patent Number: 5,037,282

[45] Date of Patent: Aug. 6, 1991

[54] ROTARY SCREW COMPRESSOR WITH OIL DRAINAGE

[75] Inventor: Arnold Englund, Spånga, Sweden

[73] Assignee: Svenska Rotor Maskiner AB, Stockholm, Sweden

[21] Appl. No.: 476,468

[22] PCT Filed: Nov. 14, 1989

[86] PCT No.: PCT/SE89/00655

§ 371 Date: Jun. 5, 1990

§ 102(e) Date: Jun. 5, 1990

[87] PCT Pub. No.: WO90/05852

PCT Pub. Date: May 31, 1990

[30] Foreign Application Priority Data

Nov. 16, 1988 [SE] Sweden ..... 8804128

[51] Int. Cl.[5] ..... F04C 18/16; F04C 29/02

[52] U.S. Cl. ..... 418/98; 418/201.1

[58] Field of Search ..... 418/76, 97–100, 418/201.1; 184/6.16

[56] References Cited

U.S. PATENT DOCUMENTS

| | | | |
|---|---|---|---|
| 3,314,597 | 4/1987 | Schibbye | 418/203 |
| 3,462,072 | 8/1969 | Schibbye | 418/98 |
| 4,211,522 | 7/1980 | Pidgeon | 418/99 |
| 4,758,136 | 7/1988 | Pamlin et al. | 418/98 |

FOREIGN PATENT DOCUMENTS

| | | | |
|---|---|---|---|
| 57-76297 | 5/1982 | Japan | 418/98 |
| 8303641 | 10/1983 | PCT Int'l Appl. | 418/98 |
| 438134 | 4/1985 | Sweden . | |
| 445130 | 6/1986 | Sweden . | |
| 1599413 | 8/1981 | United Kingdom . | |

*Primary Examiner*—John J. Vrablik

*Attorney, Agent, or Firm*—Frishauf, Holtz, Goodman & Woodward

[57] ABSTRACT

A rotary screw compressor has meshing male (2) and female (4) rotors operating in a working space limited by a high pressure end section (6), a low pressure end section (8) and a barrel section extending therebetween. The rotors (2, 4) have shaft extensions (22, 24, 26, 28) journalled in bearings (30, 32, 34, 36) in the end sections (6, 8). Oil is supplied to the bearing chambers (38, 40, 42, 44) for lubricating and cooling the bearings. The chambers (42, 44) in the low pressure end section (8) are drained to the working space through a first channel (50) and a first opening (52) in the walls (16) of the working space, and the chambers (38, 40) in the high pressure end section (6) are drained to the working space through a second channel (46) and a second opening (48) in the walls (16) of the working space.

13 Claims, 3 Drawing Sheets

ROTARY SCREW COMPRESSOR WITH OIL DRAINAGE

BACKGROUND OF THE INVENTION

The present invention relates to a rotary screw compressor for a gaseous working fluid comprising a male rotor and a female rotor mounted in a causing composed of a high pressure end section, a low pressure end section and a barrel section extending therebetween, said casing forming a working spaced generally in the shape of two intersecting parallel bores surrounded by barrel and end walls, each of said rotors having helical lobes and intermediate grooves through which the rotors intermesh forming chevron-shaped compression chambers in said working space, each of said bores housing one of said rotors, said casing being provided with an inlet port and an outlet port, each of said rotors being provided with shaft extensions mounted in bearings in said end sections and extending into first chambers in the low pressure end section and into second chambers in the high pressure end section, said low pressure end section having means for supply of liquid to aid first chambers and said high pressure end section having means for supply of liquid to said second chambers.

In compressors of this type the liquid, e.g. oil, supplied to the chambers in the end sections for bearing lubrication and other purposes usually has been drained to the low pressure channel of the compressor, as shown for instance in U.S. Pat. No. 3,314,597.

As the oil drained from the chambers in the end sections circulates within the compressor plant and gets a maximum temperature corresponding to the temperature of the working fluid in the high pressure channel, it has to be cooled down before recirculation into the compressor. However, owing to the temperature of the available cooling fluid and the practically possible size of the cooler, the oil introduced into the compressor will have a considerably higher temperature than the temperature of the working fluid to be compressed. The contact between the working fluid and the oil of the higher temperature during the inflow phase result in a healthy of the working fluid and thus is a decrease of the volumetric efficiency. There is also a considerable power required for the inflow of the oil from the low pressure channel through the low pressure port into the working space. Furthermore, a certain amount of the oil flows through the bore of the male rotor and has to be accelerated to the high speed of the tips of the lobes thereof.

A special problem arises in compressorsm forming a part of a refrigeration cycle using a working fluid of the type being dissolvable to a considerable extent in the oil, such as fluids of the type normally referred to as Freon, and commercially known for instance as R-12 and R-22. The oil supplied to the chambers in the end sections for bearing lubrication, shaft sealing, thrust balancing and similar purposes, normally has a pressure exceeding the presence in the high pressure channel of the compressor and the amount of working fluid dissolved therein is considerable. When the chambers are drained to the low pressure channel most of the working fluid is evaporated out of the oil as the solubility decreases with decreasing pressure. The amount of working fluid in this way supplied to the low pressure channel is so large that it will need a very considerable portion of the displacement volume of the compressor. The same amount of working fluid is during the compression dissolve in the oil. Owing to this fact the amount of working fluid passing through the compressor and circulating within the complete cycle will be mush less than the nominal capacity of the compressor or in other words thee volumetric efficiency of the compressor will be low.

All of the factors mentioned above will be more accentuated the smaller the dimensions of the compressr are as the amount of oil supplied to the chambers in the end sections cannot be reduced in the same proportion as the reduction of the amount of working fluid passing through the compressor.

U.S. Pat. No. 3,462,072 discloses a rotary screw compressor in which the above described problems are avoided in that the chambers in the high pressure end section are drained not to be the low pressure channel but to the working spaced of the compressor through an opening in the wall of the working space. In the embodiment shown in FIG. 3 also the chambers in the low pressure end section are drained to the working space through this opening. Although this construction avoids the problems discussed above it can only be satisfactorily used when the pressures in the bearing chambers at each side are of about the same level. As often is the case, the pressure in the chambers in the high pressure end section is higher than that in the chambers in the low pressure end section. When these pressures are short circuited through the drainage system there is a risk that high pressure oil will flow into the chambers in the low pressure end section.

British Patent No. 1,599,416 discloses another example of draining the bearing chambers. The bearing chambers in the high pressure end section are connected through a channel with the gear box and the oil from the chambers in both end sections is then drained from the gear box to the working space through a common opening in the barrel wall. The oil from the chambers in the high pressure end section thus has to circulate through the sump of the gear box and the construction requires special connections for this.

Swedish Patent No. 438 184 discloses still another drainage system, in which the bearing chambers in the high pressure end section are drained to a compression chamber in the working space, whereas the oil from the bearings in the low pressure end section together with the oil from the gear box is collected in an oil sump. Since the sump is located beneath the compressor, the oil from the sump cannot be drained to a compression chamber or the suction channel. It is therefore drained to an expanding chamber formed by the rotors, before this chamber is brought into communication with the suction port and begins to be filled with air. The vacuum thereby created is enough to suck the oil from its lower level. This system is of a very special design and if it was to be used in cases where the oil pressure in the chambers in the low pressure end section exceeds the inlet pressure conditions the drawbacks initially discussed would occur.

The object of the present invention is to improve the oil drainage system of a type similar to that disclosed in U.S. Pat. No. 3,462,072 and accomplish oil drainage from the bearing chambers in the two end sections in a new and better way.

SUMMARY OF THE INVENTION

This object has according to the invention been attained in that a compressor of the introductionally specified kind is provided with first drainage means connection said first chambers to a first opening a said walls of the working space for drainage of liquid from said first chambers and second drainage means connecting said second chambers to a second opening in said walls of the working space for drainage of liquid from said second chambers, said first opening facing a compression chamber in the working space in an area where said compression chamber is in a position in which it is cut off from communication with the inlet port or short before that, and said second opening facing a compression chamber in which the pressure is higher than in the compression chamber in which said first opening is facing.

Since the drainage system for the chambers in the high pressure end section is separated from that of the chambers in the low pressure end section and each system has its own opening in the wall of the working space, short-circuiting cannot occur and there is thus no risk for overflow of the liquid from the chambers in the high pressure end section to the chambers in the low pressure end section.

The pressure of the liquid flowing through any of the openings in the wall of the working space will be released as it flows into the compression chamber since this is a relatively large space compared with the dimensions of the drainage connections. Even if the openings face the same compression chamber, the liquid therefore will not flow from one opening to the other through the compression chamber. By locating the opening so that they face different bores and/or different compression chambers they cannot affect each other at all.

A rotary screw compressor is normally so designed that the volume of a groove in the male rotor starts to decrease immediately after it has reached its maximum volume. The moment when the volume of a groove in the female rotor starts to decrease, however, will be delayed if the female rotor has more lobes than the male rotor, which usually is the case. This means that a groove in the female rotor during a phase of the operating cycle will have constant maximum volume. For lobe combinations of e.g. 4+6 and 5+7 this phase will exceed the operating distance between two consecutive lobes. If the inlet port is so shaped that communication between the inlet port and the grooves is cut off as soon as each groove has reached it maximum volume the result therefore will be that a female rotor groove idles for a short period, i.e. the air in this closed groove will not be compressed during this period and thus remain at inlet pressure. This makes it possible to drain the bearing chambers in the low pressure end section to a female rotor groove at this stage of the operating cycle even if the pressure in the bearing chambers in only slightly above inlet pressure.

Both openings can be located in the barrel wall as well as in the high pressure end wall or one opening can be located in the barrel wall and the other one in the high pressure end wall.

If there is a gear box for transmitting the driving torque to one of the shaft extensions in the low pressure end section, also the gear box can be drained through the drainage means which drain the chambers in the low pressure end section.

The invention will be further explained in the following detailed description of an embodiment thereof and with reference to the accompanying drawings.

DETAILED DESCRIPTION

Figure 1:
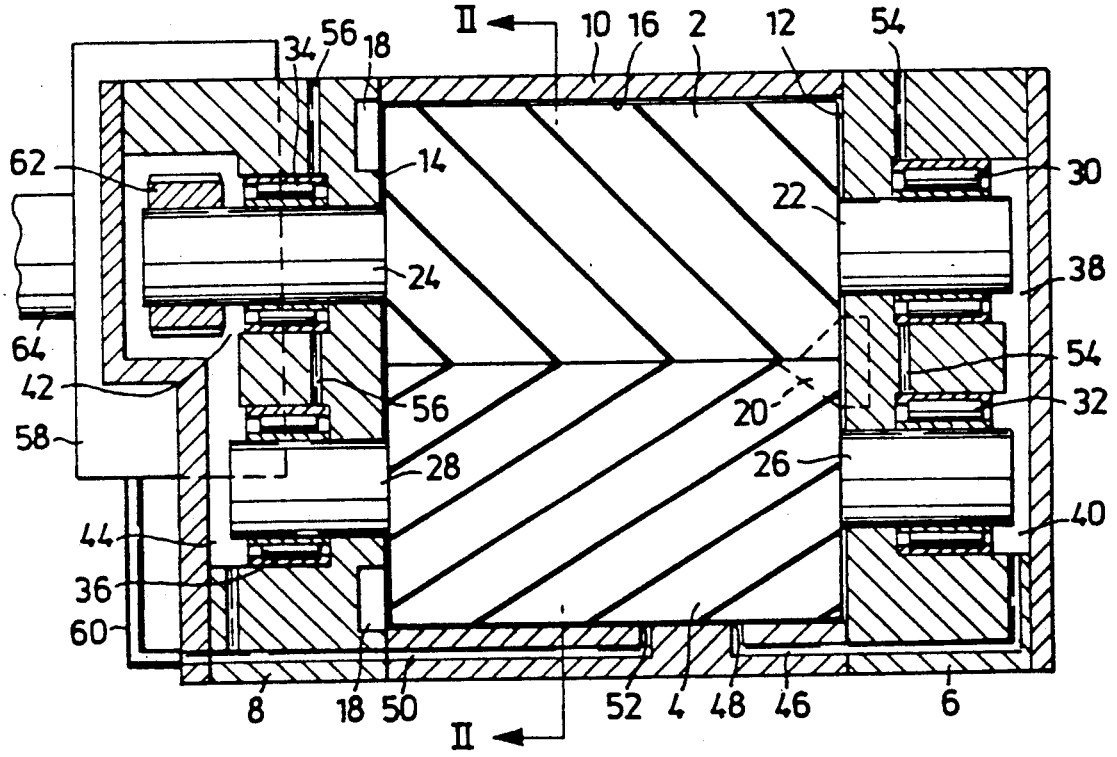
FIG. 1 is a section through the rotor axes of a compressor according to the invention.
Figure 2:
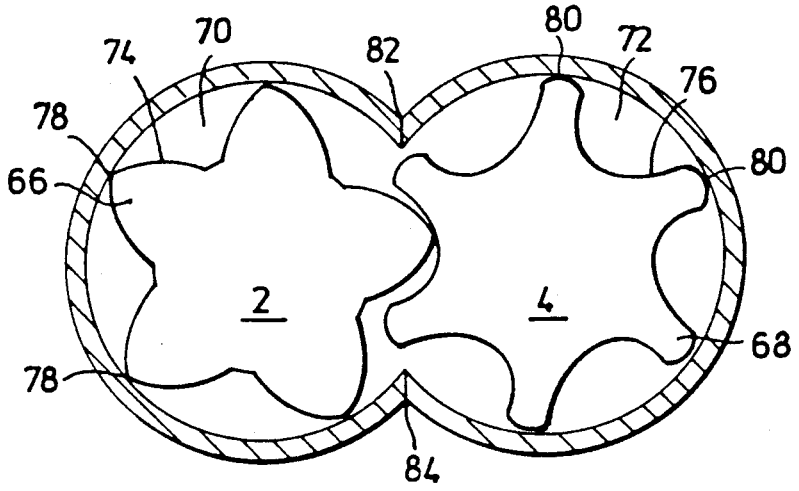
FIG. 2 is an enlarged section through the rotors along line II—II in FIG. 1.

The compressor in the figures has a pair of rotor 2, 4 operating in a working space limited by a casing comprising a high pressure end section 6, a low pressure end section 8 and a barrel section 10 extending therebetween. The working space has the shape of two intersecting bores, each one housing one of the rotors. The intersecting bores are surrounded by barrel walls 16 and end walls 12, 14 of the high and low pressure end sections 6 and 8, respectively. The rotors 2, 4 have helically extending lobes 66, 68 and intermediate grooves 70, 72 through which they intermesh forming chevron-shaped compression chambers. One rotor 2 is of the male rotor type having five lobes 66, which have flanks 74 of mainly convex geometry located mainly outside the pitch circle of the rotor. The other rotor 4 is of the female rotor type having seven lobes 68, which have flanks 76 of generally concave geometry located mainly inside the pitch circle of the rotor. Each chevron-shaped compression chamber has two legs formed by two registering grooves 70, 72 in the male 2 and female 4 rotors. A compression chamber is limited by a leading lobe and a trailing lobe on each rotor and by a part of the barrel wall and a part of one of the end walls. During an inflow phase the compression chamber communicates with an inlet port 18 connected to an inlet channel, not shown. The inflow phase of a compression chamber is ended when communication with the inlet port 18 is cut off by the trailing lobes of the two grooves forming the compression chamber when these lobes have passed the inlet port 18 and starts to seal against the inner wall of the casing. The edge of the inlet port 18 determining the moment when this occurs is called the closing edge of the inlet port.

After filling is ended the compression chamber travels axially along the compressor towards an outlet port 20 at the other end of the compressor, while continuously decreasing its volume so that the gas contained therein will be compressed. This takes place simultaneously in a plurality of axially spaced compression chambers, each one being at a different stage of the working cycle.

Each compression chamber has a leading and a trailing sealing line against the inner wall of the casing. Each of these sealing lines is during compression comprised of two helical portions confronting the barrel wall 16, which are formed by the lobe tips 78, 80 of two meshing lobes, and of two curved portions confronting the high pressure end wall 12, which are formed by the end edges of one of the flanks 74, 76 on each of these lobes. All points on such a sealing line are located in the same operating position in the working cycle. The distance between any point on the leading sealing line of a compression chamber and any point on the trailing sealing line of this compression chamber is defined as the operating distance between two consecutive lobes.

The rotor 2, 4 have shaft extensions 22, 24, 26, 28 extending into the high pressure end section 6 and the low pressure end section 8 in which the rotors 2, 4 are journalled in bearings 30, 32, 34, 36 located in chambers 38, 40, 42, 44. High pressure oil is supplied through a channel 54 to the chambers 38, 40 in the high pressure end section for lubricating and cooling the bearings 30, 32 therein. Oil is further supplied through a channel 56 to the chambers 42, 44 in the low pressure end section 8 for lubricating and cooling the bearings 34, 36 therein. The oil supplied to the low pressure end section 8 is of lower pressure than the oil supplied to the high pressure end section 6. Oil is drained from the low pressure end section 8 through a first drainage channel 50 and reaches the working space of the compressor through a first opening 52 in the barrel wall 10. Through this opening the oil flows into a groove 72 in the female rotor 4. Oil from the high pressure end section 6 is drained through a second drainage channel 46 and reaches the working space in a female rotor groove 72 through a second opening 48 in the barrel wall 10. The first opening 52 is so located that the tip of a leading lobe of a female rotor groove reaches the opening 52 shortly after the tip of the trailing lobe of that groove passes the closing edge of the inlet port 18. This groove has still its maximum volume so that the pressure therein has not yet raised from inlet pressure. The second opening 48 is located later in the working cycle, corresponding to the operating distance between two consecutive lobes.

Figure 4:
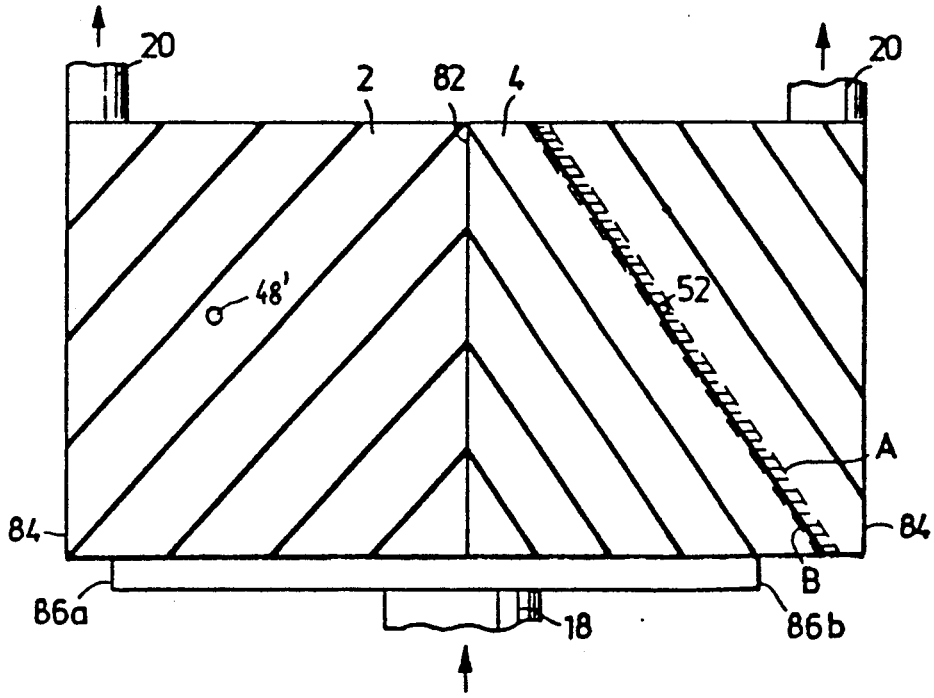
FIGS. 4 and 5 are views similar to that of FIG. 3 and showing alternative embodiments of the invention.
Figure 5:
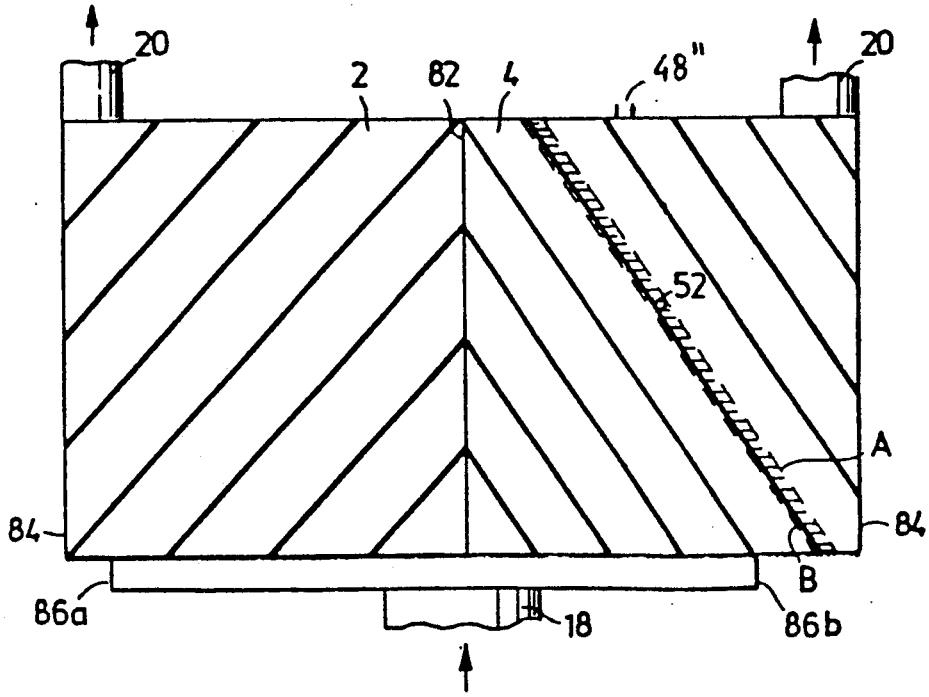

It is, however, not necessary that those openings 48, 52 are located at different stages in the working cycle. The location of the openings 48, 52 can also be varied in other respects. In the embodiment shown in FIG. 1 both openings 48, 52 face the bore that houses the female rotor 4. One or both of them, however, can be located in the other bore and one or both of them can be located in the high pressure end section 6 and face either of the bores. Alternative locations of the second drainage opening are shown in FIGS. 4 and 5. In FIG. 4 the second drainage opening 48' is located in the other bore than the first drainage opening 52, and in FIG. 5 the second drainage opening 48'' is located in the high pressure end section 12.

Figure 3:
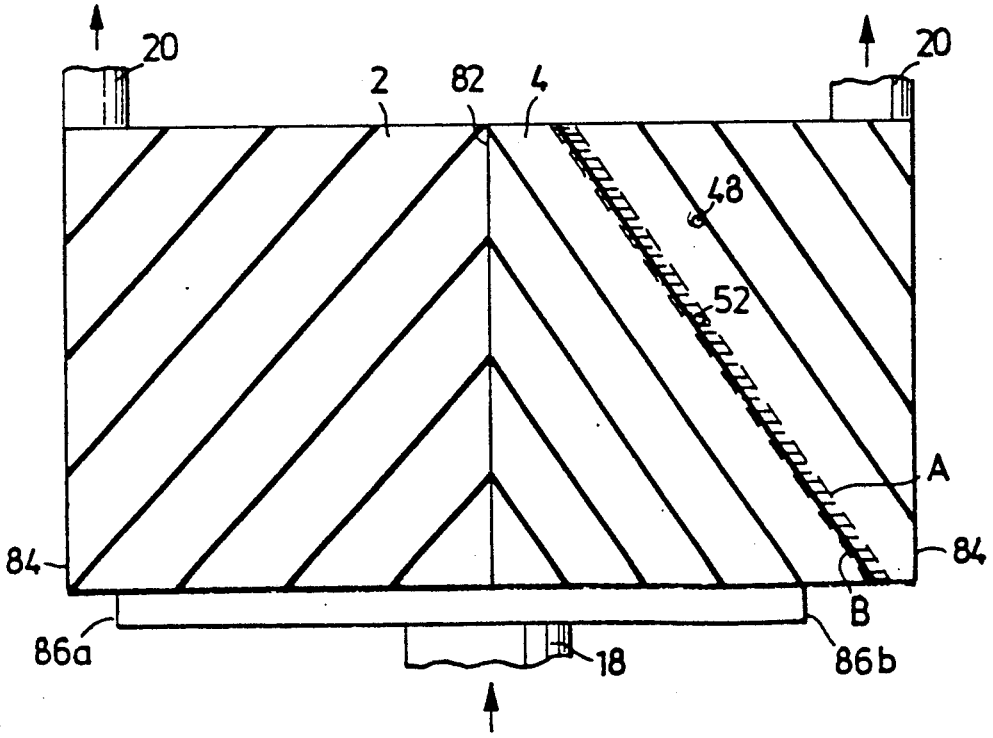
FIG. 3 is a developed view of the rotors.

The location of the first and second openings in the operating cycle is illustrated in FIG. 3 which is a schematic view of the rotors as seen from the barrel wall of the housing and developped into the plane. The lines 82 and 84 represent the two cusps, where the bores forming the casing intersect. The inlet and outlet ports 18 and 20 are for reason of clarity shown as axial ports, although they also may have radially extending portions. Communication between a rotor groove and the inlet port 18 is cut off when the trailing lobe of that groove passes the closing edge 86*a*, 86*b* of the inlet port 18. At this moment the groove has its maximum volume. As can be seen in the figure the volume of a male rotor groove then immediately starts to decrease, whereas the volume of a female rotor groove remains at maximum until the trailing lobe thereof reaches the line A in the figure. Up to this moment the closed female rotor groove still is at inlet pressure, and the first drainage opening 52 in this embodiment is located so that it faces a female rotor groove during this stage. For attaining this the opening 52 should face the working space anywhere in the shaded area in the figure, limited by the broken lines A and B. The line B indicates the position of the trailing edge of the leading lobe tip at the moment a groove is cut off from communication with the inlet port 18. The second drainage opening 48 is spaced from the first drainage opening 52 corresponding to the operating distance between two consecutive lobes.

The male rotor shaft extension 24 in the low pressure end section 8 is provided with a gear 62 meshing with a gear, not shown, on a driving shaft 64 coupled to a prime mover. The gears are contained in a gear box 58, which is provided with a drainage channel 60 connected to the drainage channel 50 from the chambers 42, 44 in the low pressure end section 8, so that oil from the gear box 58 also can be drained therethrough.

I claim:

1. Rotary screw compressor for a gaseous working fluid, comprising:

a male rotor (2) and a female rotor (4) mounted in a casing, said casing including a high pressure end section (6), a low pressure end section (8) and a barrel section (10) extending therebetween;

said casing forming a working space therein which is generally in the shape of two intersecting parallel bores surrounded by walls including a barrel wall (16) and opposite end walls (12, 14), each of said bores of said working space housing one of said rotors;

each of said male and female rotors (2, 4) having helical (66, 68) and intervening grooves (70, 72) through which the rotors intermesh, thereby forming chevron-shaped compression chambers, limited by leading and trailing lobes, in said working space;

said casing further having a inlet port (18) and an outlet port (20) communicating with said working space;

each of said rotors having shaft extensions (22, 24, 26, 28) mounted in bearings (30, 32, 34, 36) in said end sections (6, 8) and extending into first chambers (42, 44) in the low pressure end section (8) of the casing and into second chambers (38, 40) in the high pressure section (6) of the casing, said low pressure end section (8) having means (56) for supplying liquid to said first chambers (42, 44) and said high pressure end section (6) having means (54) for supplying liquid to said second chambers (38, 40);

first drainage means (50) coupling said first chambers (42, 44) to a first opening (52) in a wall (16) of said working space for drainage of liquid from said first chambers (42, 44); and second drainage means (46) coupling said second chambers (38, 40) to a second opening (48) in a wall (16) of said working space for drainage of liquid from said second chambers (38, 40);

said first opening (52) facing a compression chamber in said working space in an area where said compression chamber is in a position in which the trailing lobes of the compression chamber have passed the corresponding closing edges (86*a*, 86*b*) of the inlet port (18), so that the compression chamber has been cut off from communication with the inlet port (18); and said second opening (48) facing a compression chamber in said working space in an area in which the pressure is higher than in the compression chamber which said first opening (52) is facing.

2. A compressor according to claim 1, wherein said first (52) and second (48) openings are spaced from each other in a working cycle direction corresponding to the operating distance between two consecutive lobes.

3. A compressor according to claim 1 or 2, wherein said first opening (52) is spaced in a working cycle direction from a closing edge of the inlet port (18) corresponding to the operating distance between two consecutive lobes.

4. A compressor according to claim 3, wherein said first opening (52) faces the working space in the bore that houses the female rotor (14) and communicates with a groove of maximum volume in the female rotor.

5. A compressor according to claim 4, in which said first (52) and second (48) openings face the working space in different bores.

6. A compressor according to claim 5, wherein at least one of said first (52) and second (48) openings is located in the barrel wall (16).

7. A compressor according to claim 6, wherein at least one of said first (52) and second (48) openings is located in the high pressure end wall (12).

8. A compressor according to claim 7, further comprising a gear box (58) for transmitting a driving torque to one of said rotors (2,4), said gear box (58) being provided with third drainage means (60) connecting said gear box (58) to said first opening (52) for drainage of liquid from said gear box (58).

9. A compressor according to claim 1, wherein both of said first (52) and second (48) openings are formed in said barrel wall (16) surrounding said working space.

10. A compressor according to claim 1 or 2, wherein said first (52) and second (48) openings face the working space in respective different bores.

11. A compressor according to claim 1 or 2, wherein at least one of said first (52) and second (48) openings is located in the barrel wall (16).

12. A compressor according to claim 1 or 2 wherein at least one of said first (52) and second (48) openings is located in the high pressure end wall (12).

13. A compressor according to claim 1 or 2, further comprising a gear box (58) for transmitting a driving torque to one of said rotors (2,4), said gear box (58) being provided with third drainage means (60) connecting said gear box (58) to said first opening (52) for drainage of liquid from said gear box (58).

* * * * *